US012642401B2

(12) United States Patent
Schnitzer et al.

(10) Patent No.: US 12,642,401 B2
(45) Date of Patent: Jun. 2, 2026

(54) METHOD FOR OPERATING A MOBILE SELF-PROPELLED APPLIANCE AT A SERVICE STATION

(71) Applicant: BSH Hausgeräte GmbH, Munich (DE)

(72) Inventors: Frank Schnitzer, Bad Neustadt (DE); Dominik Schreiner, Kalbach (DE); Julius Geis, Burkardroth (DE); Stefan Hassfurter, Maroldsweisach (DE)

(73) Assignee: BSH Hausgeräte, Munich (DE)

( * ) Notice: Subject to any disclaimer, the term of this patent is extended or adjusted under 35 U.S.C. 154(b) by 78 days.

(21) Appl. No.: 18/743,383

(22) Filed: Jun. 14, 2024

(65) Prior Publication Data

US 2024/0415347 A1 Dec. 19, 2024

(30) Foreign Application Priority Data

Jun. 14, 2023 (DE) ..... 10 2023 205 528.7

(51) Int. Cl.
*A47L 9/00* (2006.01)
*A47L 9/14* (2006.01)
(Continued)

(52) U.S. Cl.
CPC ..... *A47L 9/0063* (2013.01); *A47L 9/149* (2013.01); *A47L 9/2873* (2013.01);
(Continued)

(58) Field of Classification Search
CPC ..... A47L 9/0063; A47L 9/149; A47L 9/2873; A47L 9/2894; A47L 11/4011; A47L 11/4091; A47L 2201/022; A47L 2201/024
See application file for complete search history.

(56) References Cited

U.S. PATENT DOCUMENTS

2013/0006418 A1* 1/2013 Tian ..... A47L 9/2805 700/245
2015/0202772 A1* 7/2015 Kim ..... G05D 1/0225 901/1
(Continued)

FOREIGN PATENT DOCUMENTS

CN 114073467 A 2/2022
CN 216256950 U * 4/2022
(Continued)

OTHER PUBLICATIONS

Machine Translation for CN216256950U (Year: 2022).*

*Primary Examiner* — Sharidan Carrillo
(74) *Attorney, Agent, or Firm* — Laurence A. Greenberg; Werner H. Stemer; Ralph E. Locher

(57) ABSTRACT

A method for operating a mobile self-propelled appliance at a servicing station which, in addition to charging a rechargeable battery of the appliance, offers at least one service function. The docking of the appliance at the servicing station is detected by flowing a charging current through two charging contacts of the appliance and two corresponding mating contacts of the servicing station. The servicing station checks for the presence of a communication interface of the appliance. The service function is automatically started at predetermined times or, in the absence of the communication interface of the appliance, after predefined actions of the appliance.

8 Claims, 2 Drawing Sheets

(51) Int. Cl.
*A47L 9/28* (2006.01)
*A47L 11/40* (2006.01)

(52) U.S. Cl.
CPC ..... *A47L 9/2894* (2013.01); *A47L 11/4011* (2013.01); *A47L 11/4091* (2013.01); *A47L 2201/022* (2013.01); *A47L 2201/024* (2013.01)

(56) References Cited

U.S. PATENT DOCUMENTS

| | | | | |
|---|---|---|---|---|
| 2023/0380648 | A1* | 11/2023 | Ebrahimi Afrouzi | A47L 11/4011 |
| 2024/0415347 | A1* | 12/2024 | Schnitzer | A47L 11/4091 |
| 2025/0302267 | A1* | 10/2025 | Boopathi | G01S 17/931 |

FOREIGN PATENT DOCUMENTS

| | | | | |
|---|---|---|---|---|
| DE | 102019101116 | A1 | 7/2020 | |
| EP | 2658073 | A1 * | 10/2013 | A47L 9/2873 |
| EP | 2625763 | B1 | 11/2015 | |
| EP | 4285799 | A1 | 12/2023 | |
| WO | 2022133174 | A2 | 6/2022 | |

* cited by examiner

METHOD FOR OPERATING A MOBILE SELF-PROPELLED APPLIANCE AT A SERVICE STATION

CROSS-REFERENCE TO RELATED APPLICATION

This application claims the priority, under 35 U.S.C. § 119, of German Patent Application DE 10 2023 205 528.7, filed Jun. 14, 2023; the prior application is herewith incorporated by reference in its entirety.

FIELD AND BACKGROUND OF THE INVENTION

The invention relates to a method for operating a mobile self-propelled appliance, in particular a floor cleaning appliance, such as a robot vacuum cleaner, robot sweeper and/or robot mopping machine, at a servicing station which, in addition to charging a rechargeable battery of the appliance, offers at least one service function.

Cleaning robots have the task of cleaning floors as autonomously as possible. In this case, a user is not only to be relieved of the task of the actual floor cleaning, but also a supervision or manual effort for the cleaning robot by the user is to be kept as low as possible. A rechargeable battery of the cleaning robot is recharged at a base station, which the cleaning robot visits independently if necessary. A further reduction in the user's effort is often made possible by an extraction station, at which a dust box of the cleaning robot that is filled with dust and dirt can be automatically emptied, so that the user has little or no effort with emptying.

For operation at the charging station, the cleaning robot requires two electrical contacts in order to be able to charge its rechargeable battery. In contrast, for the operation with an extraction station, additional communication interfaces, for example in the form of additional contacts, are provided in order to enable communication between the cleaning robot and the extraction station. This communication allows the cleaning robot to be emptied only when necessary, in particular when the cleaning robot explicitly informs the extraction station of this.

In order to ensure complete compatibility between cleaning robots and all stations such as charging station and extraction station, it is conventionally necessary for all cleaning robots to have an additional communication interface. Cleaning robots that are operated exclusively at a charging station only use two charging contacts. If the user purchases an extraction station at a later date, the same cleaning robot also uses the additional communication interface for communication.

Compared to cleaning robots having only two charging contacts, the additional communication interface on cleaning robots leads to cost disadvantages, in particular to increased costs, which are unnecessary in the case of simply using robots with simple charging stations. The formation of only two charging contacts on cleaning robots, however, disadvantageously deprives them of the flexibility of use with extraction stations (possibly purchased at a later date).

SUMMARY OF THE INVENTION

It is an object of the invention to provide an operating method at a servicing station or to provide a servicing station, so that the above-mentioned and other disadvantages are avoided, and in particular a service function of the servicing station can be performed in mobile self-propelled appliances even without an additional communication interface.

With the above and other objects in view there is provided, in accordance with the invention, a method for operating a mobile self-propelled appliance at a servicing station, the servicing station being configured to charge a rechargeable battery of the appliance and to offer at least one service function. The method comprises:

- detecting whether or not an appliance is docked at the servicing station by conducting a charging current via two charging contacts of the appliance and two corresponding mating contacts of the servicing station;
- checking of the servicing station for a presence of a communication interface of the appliance;
- automatically starting the at least one service function at predetermined times or, if the communication interface of the appliance is absent, after predefined actions of the appliance.

In other words, the objects of the invention are achieved with a method for operating a mobile self-propelled appliance at a servicing station which, in addition to charging a rechargeable battery of the appliance, offers at least one other service function. The method comprises the following method steps:

- detecting docking of an appliance at the servicing station by flowing a charging current via two charging contacts of the appliance and two corresponding mating contacts of the servicing station,
- checking the servicing station for the presence of a communication interface of the appliance, automatically starting the service function at predetermined times or after predefined actions of the appliance in the absence of the communication interface of the appliance.

With the method in accordance with the invention, an appliance that is optimized in terms of cost for operation at a charging station and has only two charging contacts and no communication interface can advantageously additionally be operated at the servicing station. For this purpose, the servicing station preferably comprises electronics that can distinguish and recognize different appliance variants on the basis of the existing or non-existent communication interface.

In particular, charging electronics are installed in the servicing station, which are able to charge a rechargeable battery of the docked or coupled appliance if its charging contacts are connected to the corresponding mating contacts of the servicing station. The charging electronics are preferably protected in such a manner that only rechargeable batteries that are equipped with a suitable BMS (Battery Management System) are charged. In other cases, a charging current is not provided. In this manner, it can advantageously be ensured that a charging current only flows when a suitable appliance is docked.

The method in accordance with the invention is implemented in order to be able to operate appliances independently of an existing communication interface at the servicing station. If control electronics of the servicing station detect that a charging current is flowing, it is assumed that the appliance is docked. The servicing station then checks whether the appliance is equipped with a communication interface. The further method steps of the servicing station differ depending on the result of the check. In particular, in the case of a non-existent communication interface, an automatic method starts automatically in order to perform the service function automatically even in this appliance, in particular without user intervention.

In the case of appliances without a communication interface, in particular the servicing station itself is defined as a "master," which determines a trigger for starting the service function. Neither a start command from the user nor from the appliance are necessary. The servicing station therefore starts the service function independently, without user intervention and independent of the appliance. In this case, the appliance comprises charging contacts for charging the rechargeable battery, via which no explicit communication with the servicing station takes place.

A mobile self-propelled appliance is to be understood in particular as a floor cleaning appliance which, for example, can autonomously process floor surfaces in the household area. These include, inter alia, robot vacuum cleaners and/or robot sweepers and/or robot mopping machines. For example, the mobile, self-propelled appliance is a combination appliance that can clean in both a dry and wet manner. The appliances work in operation (cleaning operation) preferably without or with as little user intervention as possible. For example, the appliance automatically travels into a predetermined room in order to clean the floor in accordance with a predetermined and programmed method strategy.

In order to be able to take into account any individual environmental characteristics, an exploration journey with the mobile self-propelled appliance preferably takes place. An exploration journey is to be understood in particular as an investigatory journey which is suitable for investigating a floor surface to be processed for obstacles, floor plan and the like. The aim of an exploration journey is, in particular, to be able to assess and/or represent the conditions of the floor processing area that is to be processed.

After the exploration journey, the mobile self-propelled appliance knows its environment and can pass it on to the user in the form of an environment map, for example in an app (cleaning app) on a mobile device. In the environment map, the user can be given the opportunity to interact with the mobile self-propelled appliance. The user can advantageously view information in the environment map and change and/or adapt the information if necessary.

During the exploration journey, the appliance preferably detects obstacles and/or carpets located in the floor area to be processed by means of special sensors such as ultrasonic sensors, laser systems and/or camera systems using object detection algorithms. Once the position, size and shape of the obstacles have been determined, the appliance enters them into its environment map. Alternatively, a user can enter the position of the obstacles directly into the environment map when configuring the device, for example by means of the cleaning app on their mobile device.

An environment map is to be understood in particular as any map which is suitable for representing the environment of the floor processing area with all its obstacles and items. For example, the environment map shows the floor processing area having the furniture, carpets and walls contained therein in a sketch-like manner.

The environment map with the obstacles is preferably displayed in the app on a portable additional device. This is used in particular to visualize a possible interaction for the user. In the present case, an additional device is to be understood in particular as any device which is portable for a user, which is arranged outside the mobile self-propelled appliance, in particular externally and/or differentiated from the mobile self-propelled appliance, and is suitable for displaying, providing, communicating and/or transmitting data, such as, for example, a cell phone, a smartphone, a tablet and/or a computer or laptop.

The app, in particular the cleaning app, is installed on the portable additional device, which is used for the communication of the mobile self-propelled appliance with the additional device and in particular renders possible a visualization of the floor processing area, in particular the living space to be cleaned or the home or living quarters, for example indoor area. The app preferably shows the user the area to be cleaned as an environment map.

A servicing station is to be understood in particular as any base station for a mobile self-propelled appliance, in particular a cleaning robot, which, in addition to a simple charging function of the rechargeable battery of the cleaning robot, provides at least one further service function. This service function can be, in particular, an extraction of dust and dirt from the dust box of the robot, a refilling of water into a water tank of the robot and/or a cleaning or washing of wiping pads that are present on the robot for floor wiping. The service function is therefore a service task that should be performed for further floor processing in order to ensure optimal cleaning or to be able to perform the cleaning process further. In this case, the servicing station can of course also offer more than one service function.

Docking the appliance at the servicing station is to be understood in particular as a mechanical and/or electrical connection of the appliance to the servicing station. For example, the appliance has two charging contacts on its front underside, that is to say electrical contacts which are used for charging the rechargeable battery. The servicing station has two corresponding mating contacts on its base plate, which are also electrical contacts that are used to charge the rechargeable battery. In order to charge, the appliance moves onto the base plate in such a manner that its charging contacts are in mechanical and electrical connection with the mating contacts, so that a charging current can flow from the servicing station to the appliance.

A communication interface of the appliance is to be understood in particular as any interface which enables communication between the appliance and an external unit. In the present case, the external unit is in particular the servicing station. In this case, the communication interface can be one or more further electrical contacts or a contactless interface. The communication interface is particularly suitable for receiving requests from the servicing station and sending a response to the servicing station accordingly.

Automatic starting is to be understood in particular as meaning that the starting takes place automatically without any user intervention, that is to say simply as a function of the appliance. In this case, the automatic starting is triggered, for example, by a predefined action of the appliance, for example a defined number of docking processes of the appliance, for example after every fourth time of a docking process of the appliance at the servicing station. Alternatively or additionally, the automatic starting can be triggered after predetermined times or fixed time intervals, that is to say, for example, three days after the last service function has been performed.

In one advantageous embodiment, the method has the following further method steps:

- waiting for a start command to start the service function from the appliance in the case of the communication interface being present,
- starting the service function on receipt of the start command.

If the appliance therefore has a communication interface, the servicing station waits for a command from the appliance to start the service function. The servicing station does not start this service function independently. In particular, the appliance itself is defined as a "master", which determines a trigger for performing the service function. The appliance preferably detects via an internal sensor system when it makes sense to perform the service function, so that such a function is only performed if it is also necessary. The user is hardly disturbed by the execution of the service function due to the automatic system. In addition, the user can preferably specify to the appliance via the cleaning app when the execution of the service task is permitted and when not. For example, the user can prohibit service functions at certain times, for example at night.

In a further advantageous embodiment, the checking of the servicing station comprises sending a request from the servicing station to the appliance and (possibly) receiving feedback from the appliance at the servicing station via the communication interface (in the event of a communication interface being present). If the servicing station detects that a charging current is flowing, i.e. that an appliance is docked, the servicing station sends the (specific) request to the appliance. If the appliance responds (correctly), the servicing station detects that an appliance having a communication interface has docked. If the appliance does not respond or does not respond correctly, the servicing station concludes that an appliance without a communication interface has docked. In this manner, the servicing station can distinguish between an existing and a non-existent communication interface.

In a further advantageous embodiment, the service function is started automatically after a predefined tolerance time interval. The servicing station therefore waits after its request to see whether the appliance responds. A tolerance time interval is specified for the waiting time. After this tolerance time interval, the servicing station determines the "master": in the event of a response, the appliance is recognized as a master, in the absence of a response, the servicing station is recognized as a master.

In a further advantageous embodiment, the servicing station offers further service functions that start automatically or in response to a start command from the appliance, depending on the presence or absence of the communication interface. The servicing station accordingly offers a plurality of service functions, which are started partially or completely according to the same principle in accordance with the invention. The service functions can be, inter alia: extracting the dust box, washing the wiping pads, filling the water tank, blowing off the top of the appliance, cleaning the outside of the appliance and/or the external sensors.

The invention further relates to a servicing station for a mobile self-propelled appliance at which an operating method in accordance with the invention can be implemented. In addition, the invention relates to a service system for implementing an operating method in accordance with the invention of a mobile self-propelled appliance at a servicing station, which comprises the mobile self-propelled appliance and the servicing station which, in addition to charging a rechargeable battery of the appliance, offers at least one service function.

It is to be understood that in addition to the method, the servicing station and the service system, a computer program which comprises commands which, when the program is executed by a servicing station of a mobile self-propelled appliance, prompt the same to implement the method in accordance with the invention, is also included in the scope of this invention. Likewise, a computer-readable medium on which such a computer program is stored is included in the scope of this invention.

Any features, designs, embodiments and advantages relating to the method are also used in connection with the servicing station in accordance with the invention, the servicing system, the computer program and the computer readable medium, and vice versa.

Other features which are considered as characteristic for the invention are set forth in the appended claims.

Although the invention is illustrated and described herein as being embodied in a method for operating a mobile self-propelled appliance at a servicing station, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
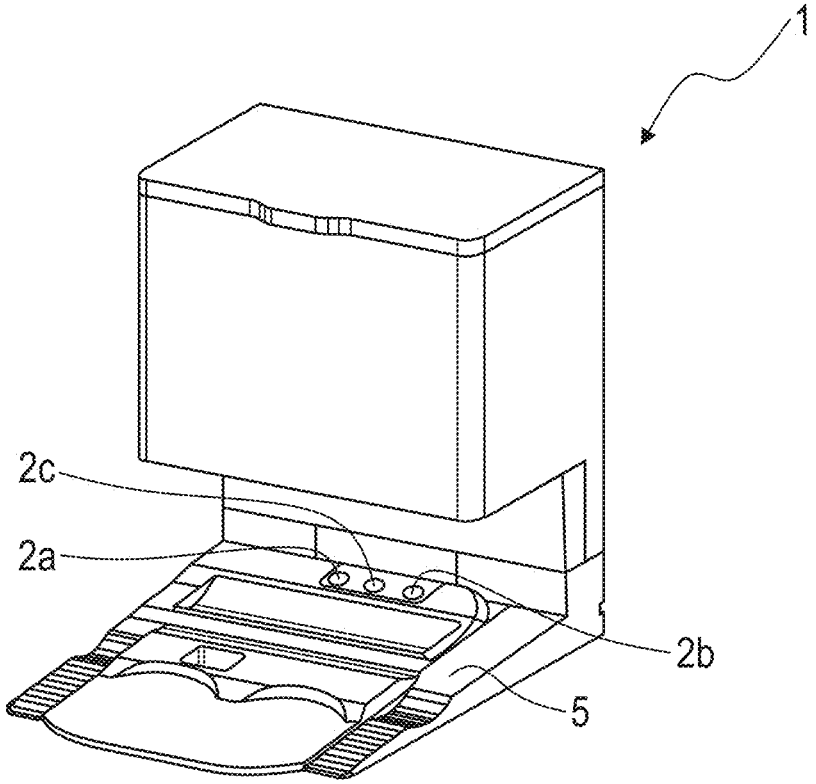
FIG. 1 shows a schematic view of an exemplary embodiment of a servicing station for a mobile self-propelled appliance with which an operating method in accordance with the invention can be implemented.

Referring now to the figures of the drawing in detail and first, in particular, to FIG. 1 thereof, there is shown a servicing station 1, or service base or service station, which is provided for charging a rechargeable battery of a mobile self-propelled appliance, in particular a cleaning robot, and which the cleaning robot visits independently if required. In order to keep the effort for a user of the cleaning robot as minimal as possible, the servicing station 1 offers at least one service function. For example, the servicing station 1 has an extraction function as a service function, due to which a filled dust box of the cleaning robot can be automatically emptied at the servicing station 1, so that the user has little effort with emptying and cleaning the cleaning robot. As an alternative or further service function, the servicing station 1 can provide a refill function for refilling a water tank of the cleaning robot. Further alternatively or additionally, a cleaning function of wiping pads of the cleaning robot can be offered as a third service function.

For simply charging the rechargeable battery of the cleaning robot at the servicing station, two contacts 2*a*, 2*b* are required. In order to be able to offer at least one service function for the cleaning robot, an additional communication interface 2*c*, in particular a further contact, is necessary in order to allow communication between the cleaning robot and the servicing station 1. This communication renders it possible for the cleaning robot not to be extracted every time it docks at the servicing station 1, but rather only when the cleaning robot explicitly informs the servicing station 1 of this, for example when the dust box is full or a longer time interval has elapsed since the last extraction. The notification that the cleaning robot requires extraction is particularly advantageous if multiple servicing stations are in use, which are not necessarily in communication with each other, but rather only communicate with the cleaning robot, so that only the cleaning robot actually knows when it was last emptied.

Figure 2:
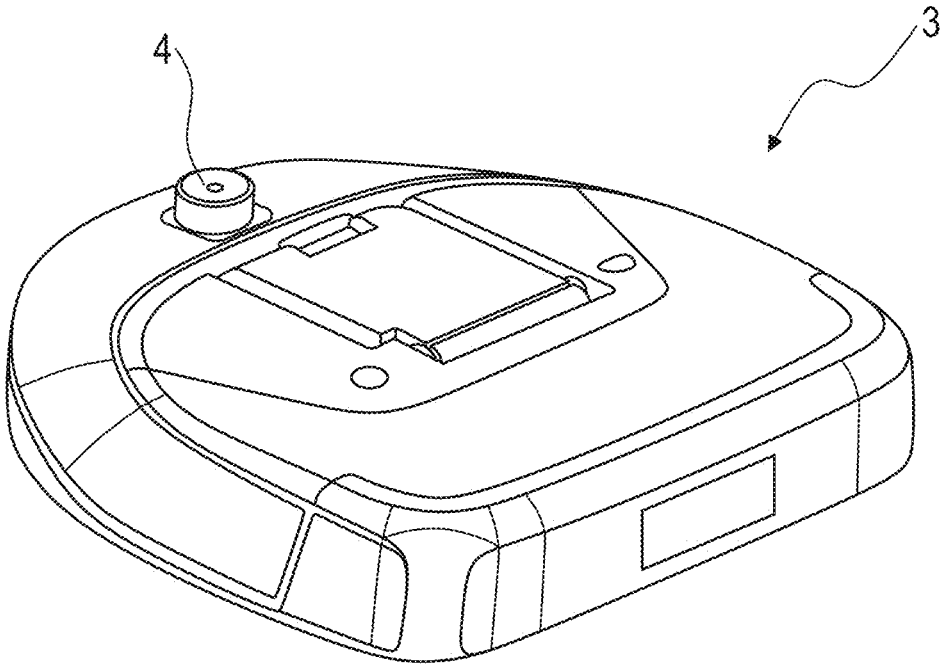
FIG. 2 shows a schematic view of an exemplary embodiment of a mobile self-propelled appliance which is provided for the operating method in accordance with the invention at a servicing station.

FIG. 2 illustrates a top view of a cleaning robot 3 that can be operated at a servicing station of the exemplary embodiment of FIG. 1. The cleaning robot 3 has a D-shape. The front of the cleaning robot is straight, while its back is curved. At a rear area, the cleaning robot 3 has a LIDAR sensor 4 with which it can explore and navigate its surroundings. The cleaning robot 3 is a robot vacuum cleaner, robot sweeper and robot mopping machine. After autonomously performing its cleaning order, it returns to its servicing station so as to charge its rechargeable battery. In this case, the cleaning robot 3 moves with its front side onto a base plate 5 of the servicing station 1 in such a manner that charging contacts of the cleaning robot 3 rest on the contacts 2*a*, 2*b* in order to be able to start charging. In particular, the cleaning robot 3 docks at the servicing station 1 by bringing its charging contacts into mechanical and electrical contact with the appropriate corresponding contacts 2*a*, 2*b* of the servicing station, so that a charging current can flow.

Figure 3A:
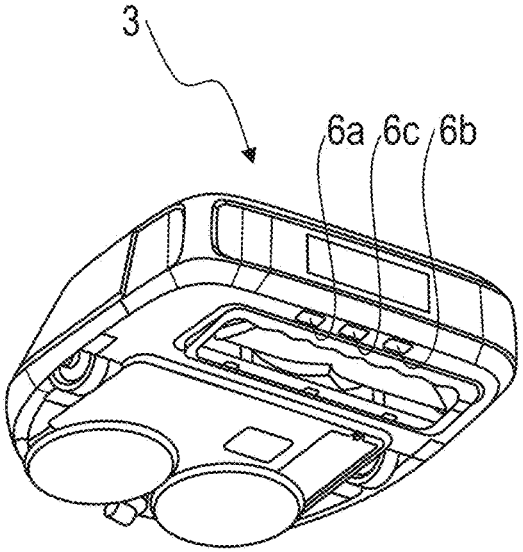
FIGS. 3A, 3B show in each case a schematic bottom view of an exemplary embodiment of a mobile self-propelled appliance which is provided for the operating method in accordance with the invention at a servicing station.
Figure 3B:
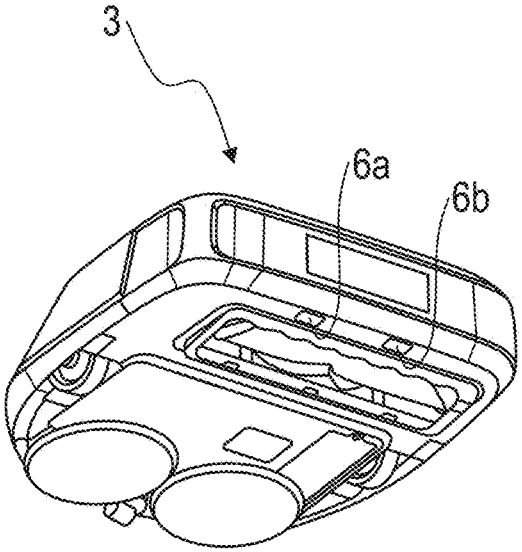

In FIGS. 3A, 3B, undersides of two different cleaning robots 3 are illustrated. The cleaning robot 3 of FIG. 3A is provided for operation at the servicing station 1 and is preferably sold with this servicing station as a package. In addition to charging contacts 6*a*, 6*b*, the cleaning robot 3 has a communication interface, for example in the form of a further electrical contact 6*c* or a contactless communication. Due to the presence of the communication interface 6*c*, the cleaning robot 3 is detected by the servicing station 1 as a robot having an interface and can inform the servicing station via the communication interface 6*c* when an execution of the service function (e.g., extracting the dust box, washing the wiping pads, replacing the water supply, filling the water tank) is to be performed. In addition, the rechargeable battery is charged via the charging contacts 6*a*, 6*b*.

The cleaning robot 3 of FIG. 3B is provided for operation at a charging station without a further service function (not shown). In particular, the cleaning robot 3 has charging contacts 6*a*, 6*b*, but not a communication interface. Explicit communication does not take place via the charging contacts 6*a*, 6*b*. Due to the lack or absence of the communication interface, the cleaning robot can be detected by the servicing station 1 of the exemplary embodiment of FIG. 2 as a robot without an interface.

Figure 4:
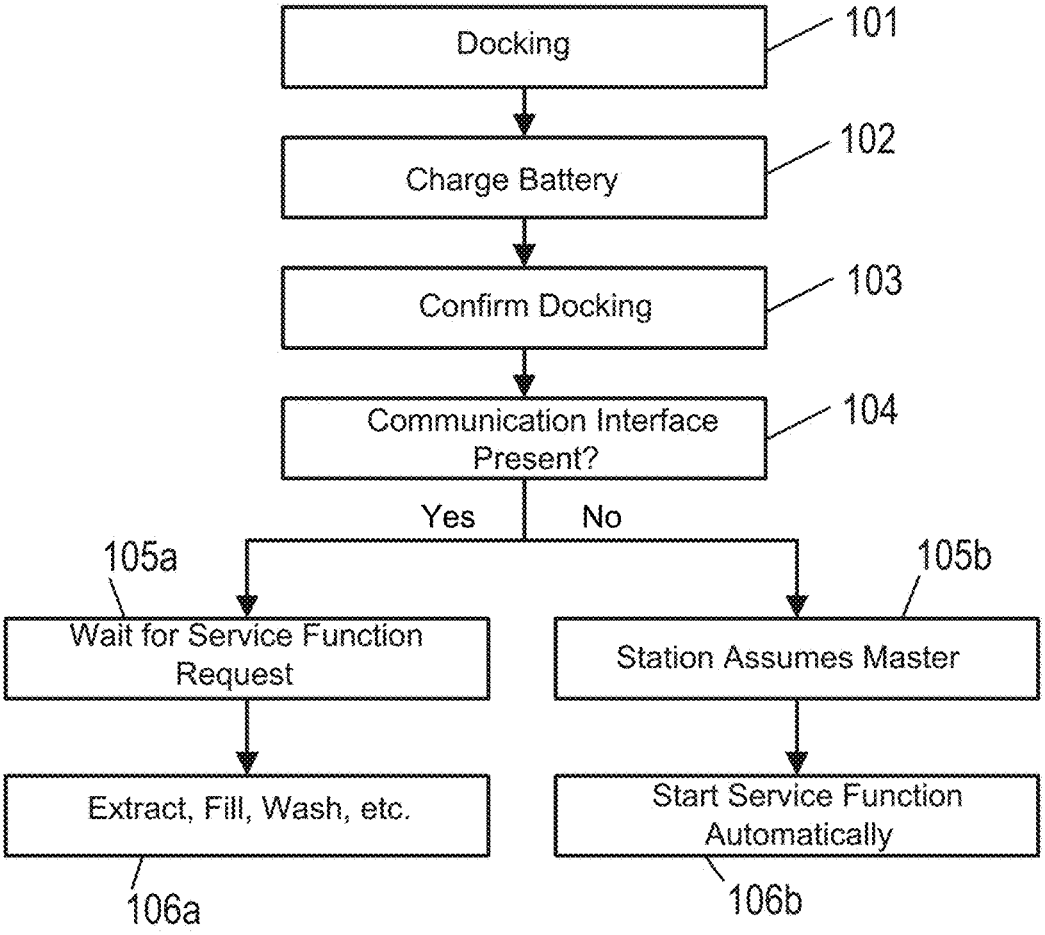
FIG. 4 shows a flowchart of an exemplary embodiment of an operating method in accordance with the invention.

In order to be able to operate both a cleaning robot 3 of the exemplary embodiment of FIG. 3A (having a communication interface) and the cleaning robot 3 of the exemplary embodiment of FIG. 3B (without a communication interface) at the servicing station 1 of the exemplary embodiment of FIG. 1, the method in accordance with the exemplary embodiment of FIG. 4 is applied.

In step 101, the cleaning robot moves to the servicing station and docks there. After docking, the charging electronics of the servicing station begins to charge the rechargeable battery of the cleaning robot (step 102). If a control electronics of the servicing station detects that a charging current is flowing, the servicing station thus detects that the cleaning robot is docked (step 103). The servicing station then checks by a test whether the cleaning robot is equipped with a communication interface (step 104). For this purpose, the servicing station sends a specific request to the cleaning robot.

If the cleaning robot responds in the affirmative, a communication interface is detected. The servicing station assumes that the cleaning robot has a communication interface (step 105*a*). In this case, the servicing station waits for a command from the cleaning robot to start one or more service functions, such as extracting, refilling, washing or the like (step 106*a*). The servicing station therefore does not start the service function independently, but rather the cleaning robot is defined as a master. The cleaning robot can itself detect via internal sensors when which service function makes sense, so that such a function is only performed if it is really necessary. The user is therefore seldom disturbed by the execution of the service function. In addition, the user can specify to the cleaning robot via the cleaning app when the execution of service functions is permitted and when not. For example, service functions can be prohibited at certain times such as at night.

If no response from the cleaning robot is received within a defined tolerance time interval after the request from the servicing station has been sent, a communication interface is not detected. The servicing station assumes in this case that the cleaning robot does not have a communication interface (step 105*b*). Here, the servicing station defines itself as a master and does not wait for a communication or a command from the cleaning robot. The servicing station starts one or more service functions automatically (step 106*b*), for example after each docking of the cleaning robot, after a defined number of docking processes by the cleaning robot (for example every fourth time) or after a fixed time interval, for example whenever three days have passed since the last service function.

Overall, it can happen that service functions are performed more often on cleaning robots without a communication interface than on cleaning robots having a communication interface, and thus there is a higher probability of a malfunction for a user. However, it is advantageous that this gives the cleaning robot, which was initially not equipped with a service function, increased functionality at the servicing station with all available service functions. The cleaning robot having only two charging contacts can therefore also be operated at the servicing station with service functions, while there are no disadvantages for cleaning robots that have a communication interface.

The invention claimed is:

1. A method for operating a mobile self-propelled appliance at a servicing station, the servicing station being configured to charge a rechargeable battery of the appliance and to offer at least one service function, the method comprising:

detecting whether or not the appliance is docked at the servicing station by conducting a charging current via two charging contacts of the appliance and two corresponding mating contacts of the servicing station;

checking of the servicing station for a presence of a communication interface of the appliance;

automatically starting, by the servicing station, the at least one service function at predetermined times or, if the communication interface of the appliance is absent, after predefined actions of the appliance.

2. The method according to claim 1, which comprises:

waiting for a start command from the appliance to start the at least one service function if the communication interface is present; and starting the at least one service function on receiving the start command.

3. The method according to claim 1, wherein the predetermined times or the predefined actions of the appliance are at least one of a defined number of docking processes of the appliance or a predetermined time interval since a last service function.

4. The method according to claim 1, wherein the step of checking of the servicing station comprises sending a request from the servicing station to the appliance and potentially receiving feedback from the appliance at the servicing station via the communication interface.

5. The method according to claim 1, wherein the servicing station offers further service functions that start automatically or in response to a start command received from the appliance, depending on a presence or an absence of the communication interface.

6. A non-transitory computer program comprising commands which, when the program is executed by the servicing station of the mobile self-propelled appliance, causes the servicing station to perform the steps of the method according to claim 1.

7. A non-transitory computer-readable data carrier having stored thereon a computer program with computer-executable commands which, when the program is executed by the servicing station of the mobile self-propelled appliance, causes the servicing station to perform the steps of the method according to claim 1.

8. The method according to claim 4, which comprises automatically starting the at least one service function if no feedback is received within a predefined tolerance time interval.

* * * * *